US008258078B2

(12) United States Patent
Dontula et al.

(10) Patent No.: US 8,258,078 B2
(45) **Date of Patent: *Sep. 4, 2012**

(54) IMAGE RECEIVER ELEMENTS

(75) Inventors: Narasimharao Dontula, Rochester, NY (US); Debasis Majumdar, Rochester, NY (US); Brian Thomas, Pittsford, NY (US); Somsack Chang, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 448 days.

This patent is subject to a terminal disclaimer.

(21) Appl. No.: 12/548,476

(22) Filed: Aug. 27, 2009

(65) Prior Publication Data

US 2011/0052843 A1 Mar. 3, 2011

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

U.S. PATENT DOCUMENTS

| | | | | |
|---|---|---|---|---|
| 5,420,095 | A | 5/1995 | Bodem et al. | |
| 5,646,090 | A | 7/1997 | Tamura et al. | |
| 5,718,995 | A | 2/1998 | Eichorst et al. | |
| 5,719,016 | A | 2/1998 | Christian et al. | |
| 6,566,033 | B1 | 5/2003 | Majumdar et al. | |
| 6,881,704 | B2 | 4/2005 | Sakamoto et al. | |
| 6,893,592 | B2 | 5/2005 | Arrington et al. | |
| 6,897,183 | B2 | 5/2005 | Arrington et al. | |
| 7,910,519 | B2 * | 3/2011 | Majumdar et al. | 503/227 |
| 2004/0001135 | A1 | 1/2004 | Soga | |
| 2004/0167020 | A1 | 8/2004 | Arrington et al. | |
| 2008/0220190 | A1 | 9/2008 | Majumdar et al. | |
| 2008/0220353 | A1 | 9/2008 | Dontula et al. | |

FOREIGN PATENT DOCUMENTS

| | | | |
|---|---|---|---|
| EP | 0 540 991 | | 4/1998 |
| EP | 1 375 176 | A1 | 1/2004 |
| JP | 03-184893 | * | 8/1991 |

OTHER PUBLICATIONS

U.S. Appl. No. 12/490,455, filed Jun. 24, 2009, titled "Method of Making Thermal Imaging Elements" by Dontula et al.
U.S. Appl. No. 12/490,464, filed 12/490,464, titled "Extruded Image Receiver Elements" by Dontula et al.

* cited by examiner

*Primary Examiner* — Bruce H Hess
(74) *Attorney, Agent, or Firm* — J. Lanny Tucker

(57) ABSTRACT

An image receiving element is a composite of multiple layers on a support including, in order, an extruded compliant layer, an aqueous-coated subbing layer, and an image receiving layer that may also be extruded. The extruded compliant layer is non-voided and comprises from about 10 to about 40 weight % of at least one elastomeric polymer. This image receiving element can be disposed on a support to form a thermal dye transfer receiver element, an electrophotographic image receiver element, or a thermal wax receiver element. Excellent adhesion is provided between the extruded compliant layer and the image receiving layer by means of the aqueous-coated subbing layer.

21 Claims, No Drawings

IMAGE RECEIVER ELEMENTS

FIELD OF THE INVENTION

The present invention relates to image receiver elements such as thermal dye transfer receiver elements in which an aqueous-coated subbing layer is adhered to an extruded compliant layer on one side and an image receiving layer (optionally extruded) on its opposite side.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Dye receiver elements used in thermal dye transfer generally include a support (transparent or reflective) bearing on one side thereof a dye image-receiving layer, and optionally additional layers, such as a compliant or cushioning layer between the support and the dye receiving layer. The compliant layer provides insulation to keep heat generated by the thermal head at the surface of the print, and also provides close contact between the donor ribbon and receiving sheet which is essential for uniform print quality.

Various approaches have been suggested for providing such a compliant layer. U.S. Pat. No. 5,244,861 (Campbell et al.) describes a composite film comprising a microvoided core layer and at least one substantially void-free thermoplastic skin layer. Such an approach adds an additional manufacturing step of laminating the composite film to the support, and film uniformity can be variable resulting in high waste factors. U.S. Pat. No. 6,372,689 (Kuga et al.) describes the use of a hollow particle layer between the support and dye receiving layer. Such hollow particles layers are frequently coated from aqueous solutions that necessitate a powerful drying stage in the manufacturing process and may reduce productivity. In addition, the hollow particles may result in increased surface roughness in the finished print that reduces surface gloss. It would be advantageous to provide a compliant layer that enables a high gloss print to be obtained. It would also be advantageous if the technology used to provide such a compliant layer also enables a matte-like print to be obtained if a low gloss finish is desired. It would be further advantageous if this low gloss finish can further be enhanced by the incorporation of additives like matte beads in an aqueous subbing layer.

U.S. Pat. No. 6,897,183 (Arrington et al.) describes a process for making a multilayer film, useful in an image recording element, wherein the multilayer film comprises a support and an outer or surface layer and between the support and the outer layer is an "antistatic subbing layer" comprising a thermoplastic antistatic polymer or composition having preselected antistatic adhesive and viscoelastic properties. Such a multilayer film may be used in making a thermal-dye-transfer receiver element comprising a support and a dye receiving layer wherein between the support and the dye receiving layer is a subbing layer. However, this patent fails to mention the importance of antistatic subbing layer adhesion to the dye receiving layer and to the support (or substrate) during printing and immediately after printing is made. Also, no mention is made of the importance of printing under hot and humid conditions, and lack of humidity sensitivity of the subbing layer compositions. U.S. Patent Application Publication 2004/0167020 (Arrington et al.) has similar disclosure in that it does not make any reference to adhesion of the dye receiver layer to the support during printing, immediately after printing, printing under hot and humid conditions, or humidity sensitivity of subbing layer compositions.

Known polymer composite laminates used on the faceside (imaging side) of dye-thermal receiver elements have a top skin layer of polypropylene (PP) onto which can be extruded a dye receiver layer (DRL) containing a polyester/polycarbonate blend. A known subbing layer used between the composite laminate support and the dye receiving layer (DRL) is antistatic and is a blend of 70 wt. % PELESTAT® 300 (polyethylene-polyether copolymer) and 30 wt. % polypropylene (PP). The rheology of these two components is such that PELESTAT® 300 encapsulates the polypropylene (PP), so that the continuous phase in the subbing layer is PELESTAT® 300. The PELESTAT® 300 acts as an antistatic material as well as an adhesive component to polymer laminate support skin layer and the dye receiving layer (DRL). This antistatic subbing layer, however, is significantly humidity sensitive, has poor adhesion, and does not survive borderless printing (edge to edge) when tested under hot and humid conditions such as 36° C./86% RH. In addition, receiver elements containing this subbing layer show poor scratch performance. Moreover, as stated previously, the application of a composite laminate film requires an additional manufacturing step.

Copending and commonly assigned U.S. Pat. No. 7,993,559 and U.S. Publication No. 2010/0330306 (both filed Jun. 24, 2009 by Dontula et al.) describe imaging elements having multiple extruded layers included extruded compliant and antistatic subbing layers. The image receiving layer can be extruded or coated out of an organic solvent. Two or more of such layers can be co-extruded if desired along with optional extruded skin layers.

In addition, copending and commonly assigned U.S. Pat. No. 7,910,519 (Majumdar et al.) describes image recording elements comprising a support having thereon an aqueous subbing layer and an extruded dye receiving layer.

There remains a need for improved adhesion of image receiving layers (such as dye transfer receiving layers) to the underlying substrate that may include an extruded compliant layer, ensuring no delamination during borderless or edge-to-edge printing. In addition, there remains a need for improved antistatic performance in such imaging elements. Further there remains a need to provide compliant and antistatic subbing layer technology that can be incorporated into the element in an efficient and cost effective manner. It is desirable to improve the scratch sensitivity of image receiving elements.

SUMMARY OF THE INVENTION

The present invention provides an imaging element comprising an image receiving layer, an extruded compliant layer, and an aqueous-coated subbing layer between the extruded compliant layer and the image receiving layer that is optionally extruded also, wherein the extruded compliant layer is non-voided and comprises from about 10 to about 40 weight % of at least one elastomeric polymer.

Some embodiments of this invention include a thermal dye transfer receiver element comprising in order on a support, an extruded compliant layer, an aqueous-coated subbing layer (that optionally is an antistatic layer), and an extruded thermal dye transfer image receiving layer, and further comprising at least one extruded skin layer immediately adjacent at least one surface of the extruded compliant layer, wherein the extruded compliant layer is non-voided and comprises:

from about 35 to about 80 weight % of a matrix polymer, from about 10 to about 40 weight % of at least one elastomeric polymer that is a thermoplastic polyolefin blend, styrene/alkylene block copolymer, polyether block polyamide, copolyester elastomer, or thermoplastic urethane, or a mixture thereof, and from about 2 to about 25 weight % of an amorphous or semi-crystalline polymer additive.

In some embodiments, the multiple layers are disposed on a support that comprises cellulose paper fibers or a synthetic paper.

In still other embodiments, an extruded skin layer is located immediately adjacent to either or both surfaces of the extruded compliant layer. These skin layers and the compliant layer can be co-extruded.

In addition, in some embodiments, the aqueous-coated subbing layer comprises polyurethane and optionally, a semiconducting metal oxide or an electrically conducting polymer.

In yet other embodiments, the element of this invention comprises an extruded thermal dye transfer receiving layer and the element is a thermal dye transfer receiver element.

The image receiving elements of this invention can be used in an assembly with an image donor element, for example as an assembly of a thermal dye transfer receiver element and a thermal dye donor element.

The elements of the present invention can be used to provide an image or material, which image can be borderless or have a border.

The present invention includes several advantages, not all of which are provided with a single embodiment. The non-voided compliant layer may be co-extruded with skin layer(s) eliminating the need for an additional manufacturing step. The non-voided compliant layer used in this invention provides enhanced adhesion, especially in situations where adhesion is humidity sensitive, between supports or substrates and image receiving layers extruded onto the substrates or supports to avoid delamination, especially around perforations, and other cut, slit, or perforated edges. The non-voided compliant layer is particularly useful on substrates containing cellulosic materials such as raw paper stock or on synthetic papers.

It is also advantageous in some embodiments that also contain an extruded "skin" layer that is immediately adjacent on either or both sides of the extruded compliant layer. In most instances, these skin layers are co-extruded with the compliant layer to provide manufacturing efficiencies.

The present invention provides desired adhesion between an extruded dye receiving layer that is typically amorphous and an extruded compliant layer that has low surface energy. In addition to its superior adhesion, use of the aqueous subbing layer has the following advantages, especially with respect to thermal receiving elements:

1) Being aqueous-coated, the subbing coating formulations are environmentally attractive and can be coated utilizing a variety of equipment.
2) The subbing layer can be thin (<1 μm) and therefore provides less separation between the image receiving layer and the highly insulating extruded compliant layer, affording printing at a lower voltage.
3) The aqueous-coated subbing layer allows the incorporation of relative humidity (RH)-independent electronically conductive materials, which are typically difficult to process thermally.
4) The aqueous-coated subbing layer obviates the need for co-extrusion with the image receiving layer.
5) The extruded compliant layer provides manufacturing benefits by eliminating the need to laminate a composite film to the support.
6) The aqueous-coated subbing layer improves the scratch resistance of image receiving elements comprising an extruded compliant layer.

DETAILED DESCRIPTION OF THE INVENTION

Definitions

Unless otherwise indicated, the terms "imaging element", "thermal dye receiver element", and "receiver element" refer to embodiments of the present invention.

The present invention relates to a multilayer film that is useful as an imaging element in an image recording element. This film includes an image receiving layer (IRL), an extruded compliant layer, and an aqueous-coated subbing layer between the extruded compliant layer and the IRL. One or more extruded skin layers can be located immediately adjacent on either or both surfaces of the extruded compliant layer. This multilayer film can be applied to a suitable support (described below).

In one embodiment of the invention, the multilayer film is used to provide a thermal dye transfer receiver element comprising a support and the three or more layers disposed thereon.

As used herein, the term "imaging element" comprises the various layers described herein including a non-voided compliant layer, an aqueous-coated subbing layer, and at least one image receiving layer and can be used in multiple techniques governing the thermal transfer of an image onto the imaging element. Such techniques include thermal dye transfer, electrophotographic printing, thermal wax transfer, or inkjet printing. The imaging elements may be desired for reflection viewing, that is having an opaque support, or desired for viewing by transmitted light, that is having a transparent support.

The terms as used herein, "top", "upper", and "face" mean the side or toward the side of the imaging member bearing the imaging layers, image, or layer receiving the image.

The terms "bottom", "lower side", and "back" refer to the side or toward the side of the imaging member opposite from the side bearing the imaging layers, image, or layer receiving the image.

The term "non-voided" as used to refer to the extruded compliant layer as being devoid of added solid or liquid matter or voids containing a gas.

The term "voided polymers" will include materials comprising microvoided polymers and microporous materials known in the art. A foam or polymer foam formed by means of a blowing agent is not considered a voided polymer for purposes of the present invention.

"Image receiving layer" (IRL) can be a "dye receiving layer" (DRL).

The term "aqueous-coated" refers to layers coated from a coating formulation wherein the coating medium is substantially (at least 75 volume %) water.

Compliant Layer

The compliant layer present in the extruded imaging element is provided by extruding one or more elastomeric polymers such as a thermoplastic polyolefin blend, styrene/alkylene block copolymer, polyether block polyamide, copolyester elastomer, or thermoplastic urethane. Generally, the compliant layer comprises multiple resins, at least some or which are elastomeric including but not limited to, thermoplastic elastomers like polyolefin blends, styrene block copolymers (SBC) like styrene-ethylene/butylene styrene (SEBS) or styrene-ethylene/propylene styrene (SEPS) or styrene butadiene styrene (SBS) or styrene isoprene styrene (SIS), polyether block polyamide (Pebax® type polymers), thermoplastic copolyester elastomer (COPE), thermoplastic urethanes (TPU) and semicrystalline polyolefin polymers such as ethylene/propylene copolymers (for example, available as Vistamaxx™ polymers). One or more elastomeric resins are present in an amount of from about 10 to about 40 weight %, or typically from about 15 to about 30 weight %.

The compliant layer generally also includes one or more "matrix" polymers that are not generally elastomeric. Such polymeric materials include but are not limited to, polyolefins such as polyethylene, polypropylene, their copolymers, functionalized or grafted polyolefins, polystyrene, polyamides like amorphous polyamide (like Selar), and polyesters. The amount of one or more matrix polymers in the compliant layer is generally from about 35 to about 80 weight % or typically from about 40 to about 65 weight %.

In some embodiments, the compliant layer also includes a third component that is an additive amorphous or semi-crystalline polymer such as cyclic olefins, polystyrenes, maleated polyethylene (such as Dupont Bynel® grades, Arkema's Lotader® grades) that can be present in an amount of from about 2 to about 25 weight %, or typically from about 5 to about 20 weight %.

Depending on the manufacturing process and thickness of the extruded compliant layer, the various types of resins are used individually or in mixtures or blends. For example, useful compliant layer resin blends include blends of ethylene/ethyl acrylate copolymers (EEA), ethylene/butyl acrylate copolymers (EBA), or ethylene/methyl acrylate copolymers (EMA) with SEBS like Kraton® G1657M; EEA, EBA, or EMA with SEBS and polypropylene; EEA, EBA, or EMA polymers with SEBS and polystyrene; EEA or EMA with SEBS and cyclic polyolefins (like Topas); polypropylene with Kraton® polymers like FG1924, G1702, G1730M; polypropylene with ethylene propylene copolymers like Exxon Mobil's Vistamaxx™ grades; or blends of low density polyethylene (LDPE) with amorphous polyamide like Dupont's Selar and Kraton® FG grade of polymers and an additive compound such as maleated polyethylene (Dupont Bynel® grades, Arkema's Lotader® grades).

For example, some embodiments include combinations of polymers in the extruded compliant layer that comprise from about 40 to about 65 weight % of a matrix polymer, from about 10 to about 40 weight % of the elastomeric polymer, and from about 5 to about 20 weight % of an amorphous or semi-crystalline polymer additive. The weight ratio of the three components can be varied and optimized based on the layer structure and the resins used.

The resin compositions in the extruded compliant layer are optimized for printer performance as well as ability to manufacture at high speeds using a high temperature process like extrusion coating. Extrusion requires the resins to have thermal stability, must have the ability to be drawn down, have the appropriate shear viscosity and melt strength, and must have good release from a chill roll. The shear viscosity range of the compliant layer resins and resin blends should be from about 1,000 poise to about 100,000 poise at 200° C. at a shear rate of 1 $s^{-1}$, or from about 2,000 poise to about 50,000 poise at 200° C. at a shear rate of 1 $s^{-1}$.

The dry final thickness of the extruded compliant layer is generally from about 15 to about 70 μm or typically from about 20 to about 45 μm.

The compliant layer resin formulation can be applied using high temperature extrusion processes like cast extrusion or extrusion coating or hot melt at a temperature of from about 200 to about 285° C. at an extrusion speed of from about 0.0508 m/sec to about 5.08 m/sec. Useful extrusion speeds are high speeds due to productivity constraints and for economical reasons. In some instances, the resulting compliant layer can be extruded at a thickness greater than the final thickness at slow speeds, but then stretched or made thinner by an orientation process that results in coating on a support at a higher speed. A less desirable variation of the orientation process is biaxial orientation of the extruded compliant layer and laminating it to a support.

As described in more detail below, the compliant layer can be formed by co-extrusion with one or more other extruded layers (such as skin layers described below) in the imaging element.

An advantage of high temperature extrusion processes is that the roughness of the topmost surface of the element (image receiving layer) is determined by the chill roll or the casting wheel. This can be of a roughness average $R_a$ of less than 0.4 μm and $R_z$ of less than 1.5 μm. On coating the top side of the support with the extruded compliant, aqueous-coated subbing, and image receiver layers (as described above), the image receiver element roughness characteristics may or may not be different than the roughness of the top surface of the underlying support.

The extruded compliant layer can also include additives such as opacifiers like titanium dioxide, calcium carbonate, colorants, dispersion aids like zinc stearate, chill roll release agents, antioxidants, UV stabilizers, and optical brighteners.

Skin Layer(s)

The imaging element can also include one or more skin layers, on either or both sides of the extruded compliant layer. Such skin layers can be composed of polyolefins such as polyethylene, copolymers of ethylene, like ethylene/methyl acrylate (EMA) copolymers, ethylene/butyl acrylate (EBA) copolymers, ethylene/ethyl acrylate (EEA) copolymers, ethylene/methyl acrylate/maleic anhydride copolymers, or blends of these polymers. The acrylate content in the skin should be so adjusted that it does not block in roll form, or antiblock additives can be added to the layer formulation. Different skin layers can be used on opposite sides of the extruded compliant layer. Elastomers (as described above for the extruded compliant layer) can be present in the skin layers if desired.

The thickness of the image side skin layer can be from up to 10 μm, and typically up to 8 μm. The resin choice and the overall composition of the topmost surface of the support is optimized to obtain good adhesion to the aqueous-coated subbing layer and enable good chill roll or casting wheel release.

A skin layer on the support side of the extruded compliant layer can be similarly composed and have a thickness of up to 70 μm, and typically up to 15 μm.

The skin layers can be extruded individually at high temperatures of from about 200 to about 285° C. at speeds of from about 0.0508 m/sec to about 5.08 m/sec. Alternatively, they can be co-extruded (extruded simultaneously) with the compliant layer and cast on a chill roll, casting wheel, or cooling stack. A particularly useful configuration is the presence of a skin layer on the topmost surface of the support.

Aqueous-Coated Subbing Layer

The aqueous-coated subbing layer comprises polymeric materials that provide excellent adhesion to the extruded compliant layer (and skin layer if present) as well as the image dye receiving layer that may also be extruded. Typically, the subbing layer comprises a film-forming polymer that can be one or more of a water soluble polymer, a hydrophilic colloid, or a water insoluble polymer latex or dispersion. However, it is generally humidity insensitive, in order to ensure invariant performance under a wide range of humidity conditions at users end. In this regard, the film-forming polymer(s) in the layer, upon drying, absorbs less than 10%, typically less than 5% or less than 2%, or even less than 1% of its weight of moisture under 80% RH at 23° C.

Useful polymers include polymers and interpolymers prepared from ethylenically unsaturated monomers such as styrene, styrene derivatives, acrylic acid or methacrylic acid and their derivatives, olefins, chlorinated olefins, (meth)acrylonitriles, itaconic acid and its derivatives, maleic acid and its derivatives, vinyl halides, vinylidene halides, vinyl monomer having a primary amine addition salt, vinyl monomer containing an aminostyrene addition salt and others. Also useful are polyurethanes and polyesters. The Tg of the binder polymer is generally below 45° C., typically below 40° C., or below 25° C. and ideally at or below 15° C., in order to ensure sufficient flow during thermal extrusion of the dye receiving layer over the antistatic subbing layer, and thus provide desired adhesion. The binder polymer can be semi-crystalline or amorphous. Useful binder polymers are disclosed for example in U.S. Pat. Nos. 6,171,769; 6,120,979; and 6,077,656; 6,811,724; and 6,835,516, all incorporated herein by reference, because of their excellent adhesion characteristics.

In order to provide appropriate static protection to the imaging element during its manufacturing, finishing, and end use, it is desirable that the aqueous-coated subbing layer be an "antistatic layer" and also contain one or more antistatic agents such as electrically conductive materials. Any electrically conductive material can be used for this purpose.

Electrically conductive materials can be divided into two broad groups: (i) ionic conductors and (ii) electronic conductors. In ionic conductors charge is transferred by the bulk diffusion of charged species through an electrolyte. Electronic conductors such as conjugated electronically conducting polymers, conducting carbon particles including single- or multi-walled carbon nanotubes, crystalline semiconductor particles, amorphous semiconductive fibrils, and continuous conductive metal or semiconducting thin films can be used in this invention to afford humidity independent, process-surviving antistatic protection. Of the various types of electronic conductors, electronically conductive metal-containing particles, such as semiconducting metal oxides, and electronically conductive polymers, such as, substituted or unsubstituted polythiophenes, substituted or unsubstituted polypyrroles, and substituted or unsubstituted polyanilines are effective.

Conductive metal-containing particles that may be used include conductive metal particles, inorganic oxides, metal antimonates, and inorganic non-oxides such as crystalline inorganic oxides such as zinc oxide, titania, tin oxide, alumina, indium oxide, silica, magnesia, barium oxide, molybdenum oxide, tungsten oxide, and vanadium oxide or composite oxides thereof, as described in, for example, U.S. Pat. Nos. 4,275,103, 4,394,441, 4,416,963, 4,418,141, 4,431,764, 4,495,276, 4,571,361, 4,999,276, and 5,122,445, all incorporated herein by reference. Tin oxide is particularly useful. The conductive crystalline inorganic oxides may contain a "dopant" in the range from 0.01 to 30 mole %, such as aluminum or indium for zinc oxide, niobium or tantalum for titania, and antimony, niobium or halogens for tin oxide. Alternatively, the conductivity can be enhanced by formation of oxygen defects by methods well known in the art. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694, incorporated herein by reference, is specifically contemplated.

Another useful category of electronically conductive metal-containing particles, which may be used in the antistatic subbing layer, includes acicular doped metal oxides, acicular metal oxide particles, and acicular metal oxides containing oxygen deficiencies. The acicular conductive particles generally have a cross-sectional diameter less than or equal to 0.02 μm and an aspect ratio greater than or equal to 5:1. Some of these acicular conductive particles are described in U.S. Pat. Nos. 5,719,016, 5,731,119, 5,939,243, and references therein, all of which are incorporated herein by reference.

If used, the volume fraction of the acicular electronically conductive metal oxide particles in the dried antistatic subbing layer can vary from 1 to 70% and typically from 2 to 50% for optimum physical properties. For non-acicular electronically conductive metal oxide particles, the volume fraction can vary from 1 to 90%, and typically from 5 to 80%.

The invention can also include a conductive "amorphous" gel such as vanadium oxide gel comprised of vanadium oxide ribbons or fibers that can be made in a number of known ways. The vanadium oxide gel can be doped with silver to enhance conductivity.

Useful conductive metal antimonates include those as disclosed in, U.S. Pat. Nos. 5,368,995 and 5,457,013, for example, both incorporated herein by reference. Several colloidal conductive metal antimonate dispersions are commercially available from Nissan Chemical Company in the form of aqueous or organic dispersions. If used, the volume fraction of the conductive metal antimonates in the dried antistatic layer can vary from 15 to 90%.

Conductive inorganic non-oxides suitable for use as conductive particles include metal nitrides, metal borides and metal silicides, which may be acicular or non-acicular in shape. Examples of these inorganic non-oxides include titanium nitride, titanium boride, titanium carbide, niobium boride, tungsten carbide, lanthanum boride, zirconium boride, molybdenum boride and the like. Examples of conductive carbon particles, suitable for incorporation in the antistatic subbing layer as conductive agent, include carbon black and carbon fibrils or nanotubes with single walled or multi-walled morphology. Examples of such suitable conductive carbon particles can be found in U.S. Pat. No. 5,576,162 that is incorporated herein by reference.

Suitable electrically conductive polymers include electronically conducting polymers, such as those illustrated in U.S. Pat. Nos. 6,025,119, 6,060,229, 6,077,655, 6,096,491, 6,124,083, 6,162,596, 6,187,522, and 6,190,846, all of which are incorporated herein by reference. These electronically conductive polymers include conjugated polymers such as substituted or unsubstituted aniline-containing polymers (as disclosed in U.S. Pat. Nos. 5,716, 550, 5,093,439, and 4,070, 189, all incorporated herein by reference), substituted or unsubstituted polythiophenes (as disclosed in U.S. Pat. No. 5,300,575, 5,312,681, 5,354,613, 5,370,981, 5,372,924, 5,391,472, 5,403,467, 5,443,944, 5,575,898, 4,987,042 and 4,731,408, all incorporated herein by reference), substituted or unsubstituted pyrrole-containing polymers (as disclosed in U.S. Pat. Nos. 5,665,498 and 5,674,654, both incorporated herein by reference), and poly(isothianaphthene) or derivatives thereof. These conducting polymers may be soluble or dispersible in organic solvents or water or mixtures thereof. Useful conducting polymers include polypyrrole styrene sulfonate (referred to as polypyrrole/poly(styrene sulfonic acid) in U.S. Pat. No. 5,674,654, incorporated herein by reference), 3,4-dialkoxy substituted polypyrrole styrene sulfonate, and 3,4-dialkoxy substituted polythiophene styrene sulfonate because of their color. A useful substituted electronically conductive polymers include poly(3,4-ethylene dioxythiophene styrene sulfonate), such as Clevios® P, PHC, and PAG all supplied by H.C. Starck Corporation, for its apparent availability in relatively large quantity. Suitable conductivity enhancing agents (CEA) such as organic compounds containing dihydroxy, poly-hydroxy, carboxyl, amide, or lactam groups, can be added to the conductive polymer for increased conductivity, as described in U.S. Pat. No. 7,427,441 and references therein. Particularly suitable CEA include sugar, sugar derivatives, ethylene glycol, glycerol, di- or triethylene glycol, N-methylpyrrolidone, pyrrolidone, caprolactam, N-methyl caprolactam, dimethyl sulfoxide, and N-octylpyrrolidone. The weight % of the conductive polymer in the dried antistatic subbing layer of the invention can vary from 1 to 99% but typically varies from 2 to 30% for optimum physical properties.

Humidity dependent, ionic conductors are traditionally more cost-effective than electronic conductors and find widespread use in reflective imaging media such as paper. Any such ionic conductor can be incorporated in the aqueous-coated antistatic subbing layer. The ionic conductors can comprise inorganic and/or organic salt. Alkali metal salts particularly those of polyacids are effective. The alkali metal can comprise lithium, sodium, or potassium and the polyacid can comprise polyacrylic or polymethacrylic acid, maleic acid, itaconic acid, crotonic acid, polysulfonic acid or mixed polymers of these compounds, as well as cellulose derivatives. The alkali salts of polystyrene sulfonic acid, naphthalene sulfonic acid or an alkali cellulose sulfate are useful.

Polymerized alkylene oxides, particularly combinations of polymerized alkylene oxides and alkali metal salts, described in U.S. Pat. Nos. 4,542,095 and 5,683,862 incorporated herein by reference, are also useful. Specifically, a combination of a polyethylene ether glycol and lithium nitrate is a desirable choice because of its performance and cost. In such a combination, the combined weight % of the polyethylene ether glycol and lithium nitrate in the dry subbing layer can vary between 1-50%, or typically between 1-30%. Furthermore, in such a combination, the weight ratio of polyethylene ether glycol to lithium nitrate in the dry antistatic subbing layer can vary between 1:99 to 99:1, or between 10:90 and 90:10.

Also useful are inorganic particles such as electrically conductive synthetic or natural smectite clay as conductive agents in the antistatic subbing layer. Also useful are the ionic conductors disclosed in U.S. Pat. Nos. 5,683,862, 5,869,227, 5,891,611, 5,981,126, 6,077,656, 6,120,979, 6,171,769, and references therein, all incorporated herein by reference.

The conductive particles that can be incorporated in the aqueous-coated antistatic subbing layer are not specifically limited in particle size or shape. The particle shape may range from roughly spherical or equiaxed particles to high aspect ratio particles such as fibers, whiskers, tubes, platelets or ribbons. Additionally, the conductive materials described above may be coated on a variety of other particles, also not particularly limited in shape or composition. For example the conductive inorganic material may be coated on non-conductive silica, alumina, titania and mica particles, whiskers or fibers.

The aqueous-coated subbing layer may comprise a colloidal sol, which may or may not be electrically conductive, to improve physical properties such as durability, roughness, coefficient of friction, as well as to reduce cost. Useful colloidal sols include finely divided inorganic particles in a liquid medium such as water. The inorganic particles can be metal oxide based such as tin oxide, titania, antimony oxide, zirconia, ceria, yttria, zirconium silicate, silica, alumina, such as boehmite, aluminum modified silica, as well as other inorganic metal oxides of Group III and IV of the Periodic Table and mixtures thereof. The selection of the inorganic metal oxide sol is dependent on the ultimate balance of properties desired as well as cost. Inorganic particles such as silicon carbide, silicon nitride and magnesium fluoride when in sol form are also useful. The inorganic particles of the sol have an average particle size less than 100 nm, typically less than 70 nm or less than 40 nm. A variety of useful colloidal sols are commercially available from DuPont, Nalco Chemical Co., and Nyacol Products Inc.

The weight % of the inorganic particles of the aforesaid sol is generally at least 5% and typically at least 10% of the dried layer to achieve the desired physical properties.

The aqueous-coated subbing layer can comprise any number of addenda for any specific reason such as tooth-providing ingredients (as described in U.S. Pat. No. 5,405,907, incorporated herein by reference), surfactants, defoamers or coating aids, charge control agents, thickeners or viscosity modifiers, coalescing aids, crosslinking agents or hardeners, soluble and/or solid particle dyes, antifoggants, fillers, matte beads, inorganic or polymeric particles, adhesion promoting agents, bite solvents or chemical etchants, lubricants, plasticizers, antioxidants, voiding agents, colorants or tints, roughening agents, slip agent, UV absorbers, and other addenda known in the art.

For desirable static protection, the aqueous-coated subbing layer may have a surface electrical resistivity or internal electrical resistivity of less than 13 log ohms/square, typically less than 12 log ohms/square, more typically less than 11 log ohms/square, and or less than 10 log ohms/square. It is to be understood that conductive agents and/or static dissipative agents can be incorporated anywhere within the image element besides the antistatic subbing layer. In order to obtain optimum static protection, it is desirable that the surface electrical resistivity or internal electrical resistivity of the element is less than 13 log ohms/square, typically less than 12 log ohms/square, or typically less than 11 log ohms/square.

The aqueous-coated subbing layer can be of any coverage (thickness). However, if the dry layer coverage is too low, the adhesion may not be adequate. On the other hand, if the dry layer coverage is too high it may reduce dye-transfer efficiency during printing, as well as incur unnecessarily high cost. The dry coverage of the subbing layer is generally between 100 $mg/m^2$ and 2000 $mg/m^2$ and typically between 300 $mg/m^2$ and 600 $mg/m^2$. The final thickness of the aqueous-coated subbing layer is generally from about 0.5 to about 10 μm and typically from about 0.75 μm to about 5 μm.

The adhesion of the aqueous-coated subbing layer may be further enhanced using an infrared (IR) heat treatment, wherein the image receiving layer or dye receiving layer (DRL) surface is exposed to IR heat during manufacturing or finishing. The improvement in adhesion after IR heat is dependent on surface temperature and time spent under IR heat. The optimum surface temperature of the DRL needs to be between 93-109° C. (200-228° F.). The time spent under IR heat is a function of line speeds of the manufacturing or the finishing operation and should be around 1 second.

Image Receiving Layer

The image receiving layer used in the imaging element may be formed in any suitable manner, for example using solvent or aqueous coating techniques such as curtain coating, dip coating, solution coating, printing, or extrusion coating as is known in the art, for example U.S. Pat. Nos. 5,411,931, 5,266,551, 6,096,685, 6,291,396, 5,529,972, and 7,485,402.

In most embodiments, the image receiving layer (such as a thermal dye image receiving layer) is extruded onto the aqueous-coated subbing layer. The details of such image receiving layers are provided for example in U.S. Pat. No. 7,091,157 (Kung et al.) that is incorporated herein by reference. For example, such layers may comprise, for example, a polycarbonate, a polyurethane, a polyester, polyolefin, polyvinyl chloride, poly(styrene-co-acrylonitrile), poly(caprolactone), or mixtures or blends thereof. An overcoat layer may be further coated over the image receiving layer, such as described for example, in U.S. Pat. No. 4,775,657 (Harrison et al.).

The image receiver layer generally can be extruded at a thickness of at least 100 μm and typically from about 100 to about 800 μm, and then uniaxially stretched to less than 10 μm. The final thickness of the image receiving layer is generally from about 1 to about 10 μm, and typically from about 1 μm to about 5 μm with the optimal thickness being determined for the intended purpose. The coverage for example can be from about 0.5 to about 20 g/m$^2$ or typically from about 1 to about 15 g/m$^2$.

It may be sometimes desirable for the image receiving layer (such as a thermal dye image receiving layer) to also comprise other additives such as lubricants that can enable improved conveyance through a printer. An example of a lubricant is a polydimethylsiloxane-containing copolymer such as a polycarbonate random terpolymer of bisphenol A, diethylene glycol, and polydimethylsiloxane block unit and may be present in an amount of from 10% to 30% by weight of the image receiving layer. Other additives that may be plasticizers such as esters or polyesters formed from a mixture of 1,3-butylene glycol adipate and dioctyl sebacate. The plasticizer would typically be present in an amount of from about 4% to about 20% by total weight of the dye image receiving layer.

A dye image receiving layer can be present on one or both sides of the support, and can be single- or multi-layered. The thickness ratio of the image (dye) receiving layer to the aqueous-coated subbing layer is generally from about 0.5:1 to about 30:1 or typically from about 2:1 to about 15:1, or more likely from about 2:1 to about 10:1.

Preparation of Various Layers in Element

According to some embodiments of the invention, a skin layer may be formed on either side of the extruded compliant layer or on both sides of the extruded compliant layer. These skin layers may be individually extruded on to the support described below by any of the extrusion methods like extrusion coating or cast extrusion or hot melt extrusion. In these methods, the polymer or resin blend is melted in the first step. In a second step, the melt is homogenized to reduce temperature excursions or adjusted and delivered to the die. In a third step, the skin layers are delivered onto a support or a modified support and rapidly quenched below their transition temperature (melting point or glass transition) so as to attain rigidity. For the skin layer closer to the support, the resin is delivered onto the support while the skin layer closer to the image receiving layer is delivered onto the compliant layer that has been coated on a support (this is known as modified support).

Instead of laying down the skin layer(s) individually that requires multiple stations or multiple operations, a useful method of laying down the skin layer(s) is simultaneously with the compliant layer. This is typically known as multilayer co-extrusion. In this method, two or more polymers or resin formulations are extruded and joined together in a feedblock or die to form a single structure with multiple layers. Typically, two basic die types are used for co-extrusion: multi-manifold dies and feedblock with a single manifold die although hybrid versions exist that combine feedblocks with multi-manifold dies. In the case of a multi-manifold die, the die has individual manifolds that extend its full width. Each of the manifolds distributes the polymer layer uniformly. The combination of the layers (in this case skin(s) with compliant layer) might occur inside the die before the final die land or outside the die. In the case of the feedblock method, the feedblock arranges the melt stream in the desired layer structure prior to the die inlet. A modular feedblock design along with the extruder flow rates enables the control of sequence and thickness distribution of the layers.

Overall in a first step for creating the skin layer(s), the polymer or resin blend composition is melted and delivered to the co-extrusion configuration. Similarly for the compliant layer, the resin blend composition is melted and delivered to the co-extrusion configuration. To enable good spreading and layer uniformity, the skin layer viscosity characteristics should not be more than 10 times or 1:10, or not more than 3 times or less than 1:3 difference in viscosity from that of the melt that forms the compliant layer. This promotes efficient and high quality coextrusion and avoids nonuniform layers. Layer uniformity can be adjusted by varying melt temperature. To enable good interlayer adhesion, material composition can be optimized, layer thickness can be varied, and also the melt temperature of the streams adjusted in the coextrusion configuration.

In a third step of creating a coextruded structure of skin layer(s) with a compliant layer, the coextruded layers or laminate can be stretched or oriented to reduce the thickness. In a fourth step, the extruded and stretched laminate is applied to the support described below while simultaneously reducing the temperature within the range below the melting temperature ($T_m$) or glass transition temperature ($T_g$) of the skin layer(s), for example, by quenching between two nip rollers that may have the same or different finish such as matte, rough glossy, or mirror finish.

In addition, the skin layers can be extruded separately (as noted above), or co-extruded with one or more of the other layers.

The subbing layer can be applied onto the extruded compliant layer as an aqueous formulation (see Examples below), and then the image receiving layer can be applied (extruded or solvent or aqueous coated) separately onto the aqueous-coated subbing layer. When the image receiving layer is solvent or aqueous coated it may be crosslinked during the coating or drying operation or crosslinked later by an external means like UV irradiation.

Element Structure and Supports

The particular structure of an imaging element (for example, a thermal dye receiver element) of the present invention can vary, but it is generally a multilayer structure comprising, under the image receiving layer, aqueous-coated subbing layer, extruded compliant layer, and a support (defined as all layers below the extruded compliant layer) that comprises a base support, such as a cellulose paper comprising cellulose paper fibers, a synthetic paper comprising synthetic polymer fibers, or a resin coated paper. But other base supports such as fabrics and polymer sheets can be used. The base support may be any support typically used in imaging applications. Any of the imaging elements of this invention could further be laminated to a substrate or support to increase the utility of the imaging element.

The resins used on the bottom or wire side (backside) of the paper base are thermoplastics like polyolefins such as polyethylene, polypropylene, copolymers of these resins, or blends of these resins. The thickness of the resin layer on the bottom side of the raw base can range from about 5 μm to about 75 μm and typically from about 10 μm to about 40 μm. The thickness and resin composition of the resin layer can be adjusted to provide desired curl characteristics. The surface roughness of this resin layer can be adjusted to provide desired conveyance properties in imaging printers.

The base support may be transparent or opaque, reflective or non-reflective. Opaque supports include plain paper, coated paper, resin-coated paper such as polyolefin-coated paper, synthetic paper, low density foam core based support, and low density foam core based paper, photographic paper support, melt-extrusion-coated paper, and polyolefin-laminated paper.

The papers include a broad range of papers, from high end papers, such as photographic paper to low end papers, such as newsprint. In one embodiment, Ektacolor® paper made by Eastman Kodak Co. as described in U.S. Pat. Nos. 5,288,690 and 5,250,496, both incorporated herein by reference, may be employed. The paper may be made on a standard continuous fourdrinier wire machine or on other modern paper formers. Any pulps known in the art to provide paper may be used. Bleached hardwood chemical kraft pulp is useful as it provides brightness, a smooth starting surface, and good formation while maintaining strength. Papers useful in this invention are of caliper from about 50 μm to about 230 μm typically from about 100 μm to about 190 μm, because then the overall imaged element thickness is in the range desired by customers and for processing in existing equipment. They may be "smooth" so as to not interfere with the viewing of images. Chemical additives to impart hydrophobicity (sizing), wet strength, and dry strength may be used as needed. Inorganic filler materials such as $TiO_2$, talc, mica, $BaSO_4$ and $CaCO_3$ clays may be used to enhance optical properties and reduce cost as needed. Dyes, biocides, and processing chemicals may also be used as needed. The paper may also be subject to smoothing operations such as dry or wet calendering, as well as to coating through an in-line or an off-line paper coater.

A particularly useful support is a paper base that is coated with a resin on either side. Biaxially oriented base supports include a paper base and a biaxially oriented polyolefin sheet, typically polypropylene, laminated to one or both sides of the paper base. Commercially available oriented and unoriented polymer films, such as opaque biaxially oriented polypropylene or polyester, may also be used. Such supports may contain pigments, air voids or foam voids to enhance their opacity. The base support may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 that is incorporated herein by reference. Microvoided composite biaxially oriented sheets may be utilized and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616, 4,758,462, and 4,632,869, the disclosures of which are incorporated by reference.

"Void" is used herein to mean devoid of added solid and liquid matter, although it is likely the "voids" contain gas. The void-initiating particles, which remain in the finished packaging sheet core, should be from about 0.1 to about 10 μm in diameter and typically round in shape to produce voids of the desired shape and size. The size of the void is also dependent on the degree of orientation in the machine and transverse directions. Ideally, the void would assume a shape that is defined by two opposed, and edge contacting, concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid may traverse.

Biaxially oriented sheets, while described as having at least one layer, may also be provided with additional layers that may serve to change the properties of the biaxially oriented sheet. Such layers might contain tints, antistatic or conductive materials, or slip agents to produce sheets of unique properties. Biaxially oriented sheets may be formed with surface layers, referred to herein as skin layers, which would provide an improved adhesion, or look to the support and photographic element. The biaxially oriented extrusion may be carried out with as many as 10 layers if desired to achieve some particular desired property. The biaxially oriented sheet may be made with layers of the same polymeric material, or it may be made with layers of different polymeric composition. For compatibility, an auxiliary layer may be used to promote adhesion of multiple layers.

Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The imaging element support used in the invention may have a thickness of from about 50 to about 500 μm or typically from about 75 to about 350 μm. Antioxidants, brightening agents, antistatic or conductive agents, plasticizers and other known additives may be incorporated into the support, if desired. In one embodiment, the element has an L*UVO (UV out) of greater than 80 and a b*UVO of from 0 to −6.0. L*, a* and b* are CIE parameters (see, for example, Appendix A in Digital Color Management by Giorgianni and Madden, published by Addison, Wesley, Longman Inc., 1997) that can be measured using a Hunter Spectrophotometer using the D65 procedure. "UV out" (UVO) refers to use of UV filter during characterization such that there is no effect of UV light excitation of the sample.

In another embodiment, the base support comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers; their copolymers or their blends thereof; or other polymeric systems like polyurethanes and polyisocyanurates. These materials may or may not have been expanded either through stretching resulting in voids or through the use of a blowing agent to consist of two phases, a solid polymer matrix, and a gaseous phase. Other solid phases may be present in the form of fillers that are of organic (polymeric, fibrous) or inorganic (glass, ceramic, metal) origin. The fillers may be used for physical, optical (lightness, whiteness, and opacity), chemical, or processing property enhancements of the core.

In still another embodiment, the support comprises a synthetic paper that may be cellulose-free, having a foamed polymer core or a foamed polymer core that has adhered thereto at least one flange layer. The polymers described for use in a polymer core may also be employed in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure; the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. The foamed polymer core can comprise a polymer expanded through the use of a blowing agent.

In a many embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others may also be used. These foaming agents may be used together with an auxiliary foaming agent, nucleating agent, and a cross-linking agent.

One embodiment of the invention is a thermal dye receiving element for thermal dye transfer comprising a base support and on one side thereof an extruded compliant layer, an aqueous-coated subbing layer, and an extruded thermal dye image receiving layer, and optionally one or more skin layers on either or both sides of the extruded compliant layer.

In some embodiments, the image receiver elements are "dual-sided", meaning that they have an image receiving layer (such as a thermal dye receiving layer) on both sides of the support. In such embodiments, there may be an extruded compliant layer, an aqueous-coated subbing layer, and optional skin layers, under an image receiving layer on both sides of the support. Thus, some embodiments can have the same arrangement of layers (for example, image receiving layer, aqueous-coated subbing layer, and extruded compliant layer) on each side of the support. The aqueous-coated subbing layer can have antistatic properties on either or both sides of the support.

Dye Donors Elements

Ink or thermal dye-donor elements that may be used with the extruded imaging element generally comprise a support having thereon an ink or dye containing layer.

Any ink or dye may be used in the thermal ink or dye-donor provided that it is transferable to the thermal ink or dye-receiving or recording layer by the action of heat. Ink or dye donor elements are described, for example, in U.S. Pat. Nos. 4,916,112; 4,927,803; and 5,023,228 that are all incorporated herein by reference. As noted above, ink or dye-donor elements may be used to form an ink or dye transfer image. Such a process comprises image-wise-heating an ink or dye-donor element and transferring an ink or dye image to an ink or dye-receiving or recording element as described above to form the ink or dye transfer image. In the thermal ink or dye transfer method of printing, an ink or dye donor element may be employed that comprises a poly(ethylene terephthalate) support coated with sequential repeating areas of cyan, magenta, or yellow ink or dye, and the ink or dye transfer steps may be sequentially performed for each color to obtain a multi-color ink or dye transfer image. The support may include a black ink. The support may also include a clear protective layer that can be transferred onto the transferred dye images. When the process is performed using only a single color, then a monochrome ink or dye transfer image may be obtained.

Dye-donor elements that may be used with the dye-receiving element conventionally comprise a support having thereon a dye containing layer. Any dye can be used in the dye layer of the dye-donor element provided it is transferable to the dye-receiving layer by the action of heat. Especially good results have been obtained with diffusible dyes, such as the magenta dyes described in U.S. Pat. No. 7,160,664 (Goswami et al.) that is incorporated herein by reference.

The dye-donor layer can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

Any dye transferable by heat can be used in the dye-donor layer of the dye-donor element. The dye can be selected by taking into consideration hue, lightfastness, and solubility of the dye in the dye donor layer binder and the dye image receiving layer binder.

Further examples of useful dyes can be found in U.S. Pat. Nos. 4,541,830; 4,698,651; 4,695,287; 4,701,439; 4,757,046; 4,743,582; 4,769,360; 4,753,922; 4,910,187; 5,026,677; 5,101,035; 5,142,089; 5,374,601; 5,476,943; 5,532,202; 5,804,531; 6,265,345, 7,501,382 (Foster et al.), and U.S. Patent Application Publications 2003/0181331 and 2008/0254383 (Soejima et al.), the disclosures of which are hereby incorporated by reference.

The dyes can be employed singly or in combination to obtain a monochrome dye-donor layer or a black dye-donor layer. The dyes can be used in an amount of from about 0.05 $g/m^2$ to about 1 $g/m^2$ of coverage. According to various embodiments, the dyes can be hydrophobic.

Imaging and Assemblies

As noted above, dye-donor elements and image receiving elements can be used to form a dye transfer image. Such a process comprises imagewise-heating a thermal dye donor element and transferring a dye image to a thermal dye receiver element as described above to form the dye transfer image.

A thermal dye donor element may be employed which comprises a poly(ethylene terephthalate) support coated with sequential repeating areas of cyan, magenta and yellow dye, and the dye transfer steps are sequentially performed for each color to obtain a three-color dye transfer image. The dye donor element may also contain a colorless area that may be transferred to the image receiving element to provide a protective overcoat.

Thermal printing heads which may be used to transfer ink or dye from ink or dye-donor elements to an image receiver element may be available commercially. There may be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer may be used, such as lasers as described in, for example, GB Publication 2,083,726A that is incorporated herein by reference.

In another embodiment, the imaging element may be an electrophotographic imaging element. The electrographic and electrophotographic processes and their individual steps have been well described in the prior art, for example U.S. Pat. No. 2,297,691 (Carlson). The processes incorporate the basic steps of creating an electrostatic image, developing that image with charged, colored particles (toner), optionally transferring the resulting developed image to a secondary substrate, and fixing the image to the substrate. There are numerous variations in these processes and basic steps such as the use of liquid toners in place of dry toners is simply one of those variations.

The first basic step, creation of an electrostatic image, may be accomplished by a variety of methods. The electrophotographic process of copiers uses imagewise photodischarge, through analog or digital exposure, of a uniformly charged photoconductor. The photoconductor may be a single use system, or it may be rechargeable and reimageable, like those based on selenium or organic photoreceptors.

In an alternate electrographic process, electrostatic images are created ionographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to an electrophotographic image receiving element. The receiving element is charged electrostatically, with the polarity chosen to cause the toner particles to transfer to the receiving element. Finally, the toned image is fixed to the receiving element. For self-fixing toners, residual liquid is removed from the receiving element by air drying or heating. Upon evaporation of the solvent, these toners form a film bonded to the image receiver element. For heat-fusible toners, thermoplastic polymers are used as part of the particle. Heating both removes residual liquid and fixes the toner to receiving element.

In another embodiment of this invention, the image receiver element can be used to receive a wax-based ink from an ink-jet printhead using what is known as a "phase change ink" that is transferred as described for example in U.S. Pat. No. 7,381,254 (Wu et al.), U.S. Pat. No. 7,541,406 (Banning et al.), and U.S. Pat. No. 7,501,015 (Odell et al.) that are incorporated herein by reference.

A thermal transfer assemblage may comprise (a) an ink or dye-donor element, and (b) an ink or dye image receiver element of this invention, the ink or dye image receiver element being in a superposed relationship with the ink or dye donor element so that the ink or dye layer of the donor element may be in contact with the ink or thermal dye image receiving layer. Imaging can be obtained with this assembly using known processes.

When a three-color image is to be obtained, the above assemblage may be formed on three occasions during the time when heat may be applied by the thermal printing head. After the first dye is transferred, the elements may be peeled apart. A second dye donor element (or another area of the donor element with a different dye area) may be then brought in register with the thermal dye receiving layer and the process repeated. The third color may be obtained in the same manner.

The following embodiments and their combinations are representative of those included within the present invention:

1: An imaging element comprising an image receiving layer, an extruded compliant layer, and an aqueous-coated subbing layer between the extruded compliant layer and the image receiving layer that is optionally extruded also, wherein the extruded compliant layer is non-voided and comprises from about 10 to about 40 weight % of at least one elastomeric polymer.

2: The element of embodiment 1 wherein the aqueous-coated subbing layer comprises polyurethane.

3: The element of embodiment 1 wherein the aqueous-coated subbing layer comprises one or more antistatic agents.

4: The element of embodiment 3 wherein the aqueous-coated subbing layer comprises a semiconducting metal oxide or an electronically conductive polymer.

5: The element of embodiment 3 or 4 wherein the semiconducting metal oxide is tin oxide and the electronically conductive polymer is a polythiophene.

6: The element of any of embodiments 1 to 5 wherein the aqueous-coated subbing layer is humidity insensitive.

7: The element of embodiment 6 wherein the aqueous-coated subbing layer absorbs less than 10% of its weight in moisture under conditions of 80% RH and 23° C.

8: The element of any of embodiments 1 to 7 wherein the elastomeric polymer is present in the extruded compliant layer in an amount of from about 15 to about 30 weight %.

9: The element of any of embodiments 1 to 8 wherein the elastomeric polymer comprises a thermoplastic polyolefin blend, styrene/alkylene block copolymer, polyether block polyamide, copolyester elastomer, ethylene/propylene copolymer, or thermoplastic urethane, or a mixture thereof.

10: The element of any of embodiments 1 to 9 wherein the extruded compliant layer comprises from about 35 to about 80 weight % of a matrix polymer, from about 10 to about 40 weight % of the elastomeric polymer, and from about 2 to about 25 weight % of an amorphous or semi-crystalline polymer additive.

11: The element of any of embodiments 1 to 10 further comprising an extruded skin layer immediately adjacent either or both sides of the extruded compliant layer.

12: The element of embodiment 11 wherein the extruded skin layer(s) and extruded compliant layer are co-extruded layers.

13: The element of any of embodiments 1 to 12 wherein the compliant layer is extruded as a formulation having a shear viscosity of from about 1000 to about 100,000 poise at 200° C. and a shear rate of 1 $s^{-1}$.

14: The element of any of embodiments 1 to 13 wherein the image receiving layer, aqueous-coated subbing layer, extruded compliant layer, and optional extruded skin layer(s) are disposed together on a support.

15: The element of embodiment 14 wherein the support comprises cellulose paper fibers or a synthetic paper.

16: The element of embodiment 12 wherein the extruded compliant layer has a final thickness of from about 15 to about 70 μm and any extruded skin layers have a final thickness of up to 10 μm on the image side and up to 70 μm on the support side of the extruded compliant layer.

17: The element of any of embodiments 1 to 16 wherein the aqueous-coated subbing layer has a final thickness of from about 0.5 to about 10 μm, or a dry coverage of from about 100 to about 2,000 mg/$m^2$.

18: The element of any of embodiments 1 to 17 wherein the image receiving layer comprises a polyester, a polycarbonate, a vinyl polymer, or a combination thereof.

19: The element of any of embodiments 1 to 18 wherein the image receiving layer is a thermal dye transfer image receiving layer and the element is a thermal dye transfer receiver element.

20: The element of any embodiments 1 to 19 that is a thermal dye transfer receiver element comprising in order on a support, an extruded compliant layer, an aqueous-coated subbing layer that is optionally an antistatic layer, and an extruded thermal dye transfer image receiving layer, and further comprising at least one extruded skin layer immediately adjacent at least one surface of the extruded compliant layer, wherein the extruded compliant layer is non-voided and comprises:

from about 35 to about 80 weight % of a matrix polymer, from about 10 to about 40 weight % of at least one elastomeric polymer that is a thermoplastic polyolefin blend, styrene/alkylene block copolymer, polyether block polyamide, copolyester elastomer, or thermoplastic urethane, or a mixture thereof, and from about 2 to about 25 weight % of an amorphous or semi-crystalline polymer additive.

21: An assembly comprising the imaging element of any of embodiments 1 to 20 and an image donor element.

22: The assembly of embodiment 21 wherein the imaging element is a thermal dye transfer receiver element and said image donor element is a thermal dye donor element.

The following examples are provided to illustrate the invention. In all the examples the support was created as follows.

EXAMPLES

A 0.0635 meter single screw extruder was used along with a 0.0254 m single screw extruder to create the compliant layer structures. All the compliant layers were extruded onto the imaging side of the paper at 75.76 m/min. For some structures, the compliant layer was extruded as a monolayer, and for other structures, a coextruded format was used to produce a bi-layer structure. To create these structures, appropriate feedplug configurations were used. Furthermore, to highlight the effect of materials chosen for compliant layers and to observe the effect on print roughness and printability, experiments were done using different chill rolls. Chill rolls quench the melt curtain in the nip between the chill roll and the support.

Chill rolls used in resin coating of paper rolls for silver halide supports differ in roughness according to whether a glossy or matte finish is desired in the final print. The roughness is characterized by the standard surface roughness parameters $R_a$, $R_z$ and Rmax. The chill rolls used in these examples are described as mirror or smooth glossy chill rolls whose characteristics are noted below in TABLE I. The characteristics of the chill roll surfaces were measured using a Mahr Perthometer Concept stylus profilometer.

TABLE I

| Chill Roll | Ra (μm) | Rz (μm) | Rmax (μm) |
|---|---|---|---|
| A (matte) | 1.143 | 7.976 | 9.618 |
| B (glossy) | 0.132 | 1.174 | 1.323 |
| C (mirror or smooth glossy) | <0.025 | — | <0.305 |

The check (comparative) supports were made up the paper support with an extruded compliant layer. These supports were coated on the compliant layer side with a non-aqueous antistatic subbing layer and dye receiving layer by co-extrusion of the two melts. Components of the dye receiver layer and the antistatic subbing layer were compounded into pelletized form as described later.

The dye receiver pellets were introduced into a liquid cooled hopper that fed a 0.063 m single screw extruder from Black Clawson. The dye receiver pellets were melted in the extruder and heated to 265° C. The pressure was then increased through the melt pump, and the DRL melt was pumped through a Cloeren coextrusion feedblock.

The antistatic subbing layer pellets were introduced into a liquid cooled hopper of another 0.0254 m single screw extruder. The subbing layer pellets were also heated to a temperature determined by the requirements of the composition and then pumped to the Cloeren coextrusion feedblock. For all the variations, the melt exiting the die was adjusted to be around 299° C.

The layers were coextruded through a die with a die gap set around 0.46 mm, and whose width was about 1270 mm, and coated onto the supports. The distance between the die exit and the nip formed by the chill roll and the pressure roll was kept at around 120 mm. The line speed for all the variations was 243.8 m/min and no draw resonance was observed.

The antistatic subbing layer was extruded to achieve a 1 μm thickness on the support. It was coextruded with the dye receiver layer (DRL) such that the ratio of DRL thickness to the antistatic subbing layer thickness was 2:1. The DRL formulation and antistatic subbing layer formulations are described below.

Dye Receiving Layer (DRL):

Polyester E-2 (structure and making of branched polyester described in U.S. Pat. No. 6,897,183 (Col. 15, lines 3-32), incorporated herein by reference, and U.S. Pat. No. 7,091,157 (Col. 31, lines 23-51), incorporated herein by reference, was dried in a Novatech desiccant dryer at 43° C. for 24 hours. The dryer was equipped with a secondary heat exchanger so that the temperature did not exceed 43° C. during the time that the desiccant was recharged. The dew point was −40° C.

Lexan® 151 a polycarbonate from GE, Lexan® EXRL1414TNA8A005T polycarbonate from GE, and MB50-315 silicone from Dow Chemical Co. were mixed together at a 0.819:1:0.3 ratio and dried at 120° C. for 2-4 hours at −40° C. dew point.

Dioctyl Sebacate (DOS) was preheated to 83° C. and phosphorous acid was mixed in to make a phosphorous acid concentration of 0.4%. This mixture was maintained at 83° C. and mixed for 1 hour under nitrogen before using.

These materials were then used in the compounding operation. The compounding was done in a Leistritz ZSK 27 extruder with a 30:1 length to diameter ratio. The Lexan® polycarbonates/MB50-315-silicone material was introduced into the compounder first and then melted. The dioctyl sebacate/phosphorous acid solution was added and finally the polyester was added. The final formula was 2.1% polyester, 10% Lexan® 151 polycarbonate, 6.55 wt. % Lexan® EXRL1414TNA8A005T, 6% MB50-315 silicone, 5.33% DOS, and 0.02% phosphorous acid. A vacuum was applied with slightly negative pressure and the melt temperature was 240° C. The melted mixture was then extruded through a strand die, cooled in 32° C. water, and pelletized. The pelletized dye receiver compound was then aged for about 2 weeks.

The dye receiver pellets were then predried before extrusion, at 38° C. for 24 hours in a Novatech dryer described above. The dried material was then conveyed using desiccated air to the extruder.

The various antistatic subbing layers were created using melt compounding or by making an aqueous dispersion and coating onto the support.

Extruded Subbing Layer (TL1):

TL1 was formed by compounding or melt mixing a polyether-polyolefin antistatic material from Sanyo Chemical Co., PELESTAT® 300 and Huntsman P4G2Z-159 polypropylene homopolymer in a 70:30 ratio at about 240° C. Prior to compounding PELESTAT® 300 was dried at 77° C. for 24 hours in Novatech dryers. The polymer was then forced through a strand die into a 20° C. water bath and pelletized. The compounded antistatic subbing layer pellets were then dried again at 77° C. for 24 hours in a Novatech dryer and conveyed using dessicated air to the extruder.

Aqueous Subbing Layer (TL2):

The following ingredients were used in the aqueous subbing layer of the Examples of the invention:

Neorez® R 600, 30% by weight aqueous dispersion of polyurethane latex (Tg=−32° C., supplied by DSM Neoresins, FS 10D, 20% by weight aqueous dispersion of antimony-doped conductive tin oxide supplied by Ishihara Corporation.

For the invention examples, the aqueous subbing layer was created using the following composition: 18323.86 g of Neorez® R600, 30243.38 g of FS10D, and 7691.76 g of water. TABLE II below lists the various resins used for the compliant layer and the extruded subbing layers described in the examples.

TABLE II

| Resin | Source | Resin Type | Resin Characteristics |
|---|---|---|---|
| PELESTAT ® 300 | Sanyo Chemical | Antistatic polymer in subbing layer | Polyolefin polyether block copolymer |
| Amplify ™ EA102 | Dow Chemical | Matrix polymer for compliant layer (used for subbing layer too) | Ethylene ethyl acrylate copolymer, 18.5% ethyl acrylate |
| P9H8M015PP | Huntsman | Matrix polymer for compliant layer | Polypropylene |
| Kraton ® G1657M | Kraton | Elastomer in compliant layer | Linear triblock copolymer based on styrene and ethylene/butylenes (SEBS), polystyrene content of 13%, Shore A hardness 47 |
| Vistamaxx ™ 6202 | Exxon Mobil Chemical | Elastomer in compliant layer | Specialty thermoplastic elastomer based on semicrystalline polyolefin polymers, ethylene content 15%; Shore A hardness 61 |
| 811A | Westlake Polymers | Skin layer resin | Low density polyethylene, 20 MI |
| P4G2Z159 | Huntsman | Subbing layer matrix resin | Polypropylene, 1.9 MFR |

Printing was carried out using a KODAK® 6800 printer having a KODAK® Professional EKTATHERM ribbon, catalogue number 106-7347 donor element, and evaluated for various print characteristics. The prints were also evaluated for scratch resistance using a test that is representative of customer handling situations. Scratch resistance was evaluated from Black ($D_{max}$) images using a balanced beam scrape adhesion and Mar Tester (ASTM D2197). In this test the prints were scratched with a tip whose angle was fixed at 30 degrees to the normal and at an approximate speed of 2 inches/sec (or 5.08 cm/sec). The prints were then evaluated visually for scratches. The load at which a print was scratched to white is reported. This corresponds to the load or weight at which the prints were permanently damaged. In order to get fewer customer complaints regarding scratches on prints, it would be useful to have prints that have a high resistance to scratching, or in other words the load required to scratch the print should to be high.

Comparative Example 1

Support creation: A photographic raw base of 170 μm thickness was coated on the wireside (backside) with non-pigmented polyethylene at a resin coverage of 14 g/m$^2$. On the imaging side of the photographic raw base, a coextruded structure of a compliant layer with a skin layer was created by co-extrusion coating the two resin layers against chill roll C (mirror or smooth glossy) with the skin layer being cast against the chill roll. The compliant layer was composed of (all by weight) 53.6% of Amplify™ EA102, 25.05% of Kraton® G1657, 11% of P9H8M015 PP, 10% of $TiO_2$, 0.25% of zinc stearate, and 0.1% of Irganox® 1076. The skin layer was composed of (all by weight) 89.75% of 811A LDPE, 10% of $TiO_2$, and 0.25% of zinc stearate. The layer weight ratio of the compliant layer to the skin layer was 5:1 while the total coverage of both layers was 29.29 g/m$^2$. The compliant layer resin and skin layer resins were both created by compounding in a Leistritz ZSK27 compounder.

This support was coated with an extruded antistatic subbing layer (TL1) and DRL. The antistatic subbing layer was melted such that it exited the extruder at a temperature around 232° C. The ratio of DRL to antistatic subbing layer thickness was 2:1. The resulting image receiving element was printed and evaluated for print scratch performance.

Invention Example 1

Support creation: A photographic raw base of 170 μm thickness was coated on the wireside (backside) with non-pigmented polyethylene at a resin coverage of 14 g/m$^2$. On the imaging side of the photographic raw base, a coextruded structure of a compliant layer and a skin layer was created by co-extrusion coating the two resin layers against chill roll C (mirror or smooth glossy) with the skin layer being cast against the chill roll. The compliant layer was composed of (all weight %) 53.6% of Amplify™ EA102, 25.05% of Kraton® G1657, 11% of P9H8M015 PP, 10% of $TiO_2$, 0.25% of zinc stearate, and 0.1% of Irganox® 1076. The skin layer was composed of (all weight %) 89.75% of 811A LDPE, 10% of $TiO_2$, and 0.25% of zinc stearate. The layer weight ratio of the compliant layer to the skin layer was 5:1 while the total coverage of both layers was 29.29 g/m$^2$. The compliant layer resin and skin layer resin were both created by compounding in a Leistritz ZSK27 compounder.

This support was coated with the aqueous subbing layer (TL2) at 0.344 g/m$^2$ coverage and then extrusion coated with the DRL to provide a 2 μm thickness (same thickness as Comparative Example 1). The resulting image receiving element was printed and evaluated for print scratch performance.

Comparative Example 2

Support creation: A photographic raw base of 170 μm thickness was coated on the wireside (backside) with non-pigmented polyethylene at a resin coverage of 14 g/m$^2$. On the imaging side of the photographic raw base, a coextruded structure of a compliant layer and a skin layer was created by co-extrusion coating the two resin layers against chill roll C (mirror or smooth glossy) with the skin layer being cast against the chill roll. The compliant layer was composed of (all weight %) 53.8% of P9H8M015 PP, 35.9% of Vistamaxx™ 6202, 10% of $TiO_2$, 0.25% of zinc stearate, and 0.1% of Irganox® 1076. The skin layer was composed of (all weight %) 89.75% of 811A LDPE, 10% of $TiO_2$, and 0.25% of zinc stearate. The layer weight ratio of compliant layer to skin layer was 5:1 while the total coverage was 27.83 gm/m$^2$. The compliant layer resin and skin layer resin were both created by compounding in a Leistritz ZSK27 compounder.

This support was coated with an extruded antistatic subbing layer (TL1) and DRL. The antistatic subbing layer was melted such that it exited the extruder at a temperature of around 232° C. The weight ratio of DRL to antistatic subbing layer thickness was 2:1. The resulting image receiving element was printed and evaluated for print scratch performance Invention Example 2

Support creation: A photographic raw base of 170 μm thickness was coated on the wireside (backside) with non-pigmented polyethylene at a resin coverage of 14 g/m$^2$. On the imaging side of the photographic raw base, a coextruded structure of a compliant layer with a skin layer was created by co-extrusion coating the two resin layers against chill roll C (mirror or smooth glossy) with the skin layer being cast against the chill roll. The compliant layer was composed of (all weight %) 53.8% of P9H8M015 PP, 35.9% of Vistamaxx™ 6202, 10% of $TiO_2$, 0.25% of zinc stearate, and 0.1% Irganox® 1076. The skin layer was composed of (all weight %) 89.75% of 811A LDPE, 10% of $TiO_2$, and 0.25% of zinc stearate. The weight layer ratio of the compliant layer to the skin layer was 5:1 while the total coverage of both layers was 27.83 g/m$^2$. The compliant layer resin and skin layer resin were both created by compounding in a Leistritz ZSK27 compounder.

This support was coated with the aqueous subbing layer (TL2) at 0.344 g/m$^2$ coverage and then extrusion coated with the DRL to provide a 2 μm thickness (same thickness as Comparative Example 2). The resulting image receiving layer was printed and evaluated for print scratch performance The following TABLE III provides the comparative data for scratch resistance for the Comparative and Invention Examples after image printing. It was observed that by using aqueous subbing layer according to this invention, the scratch resistance characteristics of the resulting prints were significantly improved over the prints obtained from the Comparative Examples that contained an extruded antistatic tie layer. This was a very surprising result since the aqueous subbing layer is a very thin layer and its positive impact on scratch resistance was unexpected.

TABLE III

| Element | Antistatic layer | % Average Improvement in scratch to white |
|---|---|---|
| Comparative 1 | Extruded subbing layer | Baseline |
| Invention 1 | Aqueous subbing layer | 57.14% greater than Comparative Example 1 |
| Comparative 2 | Extruded subbing layer | Baseline |
| Invention 2 | Aqueous subbing layer | 49.15% greater than Comparative Example 2 |

The invention has been described in detail with particular reference to certain preferred embodiments thereof, but it will be understood that variations and modifications can be effected within the spirit and scope of the invention.

The invention claimed is:

1. An imaging element comprising an image receiving layer, an extruded compliant layer, and an aqueous-coated subbing layer between the extruded compliant layer and the image receiving layer that is optionally extruded also, wherein the extruded compliant layer is non-voided and comprises from about 15 to about 30 weight % of at least one elastomeric polymer.

2. The element of claim 1 wherein the aqueous-coated subbing layer comprises a polyurethane.

3. The element of claim 1 wherein the aqueous-coated subbing layer comprises one or more antistatic agents.

4. The element of claim 3 wherein the aqueous-coated subbing layer comprises a semiconducting metal oxide or an electronically conductive polymer.

5. The element of claim 4 wherein the semiconducting metal oxide is tin oxide and the electronically conductive polymer is a polythiophene.

6. The element of claim 1 wherein the aqueous-coated antistatic subbing layer is humidity insensitive.

7. The element of claim 6 wherein the aqueous-coated antistatic subbing layer absorbs less than 10% of its weight in moisture under conditions of 80% RH and 23° C.

8. The element of claim 1 wherein the elastomeric polymer comprises a thermoplastic polyolefin blend, styrene/alkylene block copolymer, polyether block polyamide, copolyester elastomer, ethylene/propylene copolymer, or thermoplastic urethane, or a mixture thereof.

9. The element of claim 1 wherein the extruded compliant layer further comprises from about 35 to about 80 weight % of a matrix polymer, and from about 2 to about 25 weight % of an amorphous or semi-crystalline polymer additive.

10. The element of claim 1 further comprising an extruded skin layer immediately adjacent either or both sides of the extruded compliant layer.

11. The element of claim 10 wherein the extruded skin layer(s) and extruded compliant layer are co-extruded layers.

12. The element of claim 11 wherein the extruded compliant layer has a final thickness of from about 15 to about 70 μm and any extruded skin layers have a final thickness of up to 10 μm.

13. The element of claim 1 wherein the compliant layer is extruded as a formulation having a shear viscosity of from about 1000 to about 100,000 poise at 200° C. and a shear rate of 1 $s^{-1}$.

14. The element of claim 1 wherein the image receiving layer, aqueous-coated subbing layer, extruded compliant layer, and optional extruded skin layer(s) are disposed together on a support.

15. The element of claim 14 wherein the support comprises cellulose paper fibers or a synthetic paper.

16. The element of claim 1 wherein the antistatic subbing layer has a final thickness of from about 0.5 to about 10 μm, or a dry coverage of from about 100 to about 2,000 mg/$m^2$.

17. The element of claim 1 wherein the image receiving layer comprises a polyester, a polycarbonate, a vinyl polymer, or a combination thereof.

18. The element of claim 1 wherein the image receiving layer is a thermal dye transfer image receiving layer and the element is a thermal dye transfer receiver element.

19. An assembly comprising the imaging element of claim 1 and an image donor element.

20. The assembly of claim 19 wherein the imaging element is a thermal dye transfer receiver element and the image donor element is a thermal dye donor element.

21. A thermal dye transfer receiver element comprising in order on a support, an extruded compliant layer, an aqueous-coated subbing layer that is optionally an antistatic layer, and an extruded thermal dye transfer image receiving layer, and further comprising at least one extruded skin layer immediately adjacent at least one surface of the extruded compliant layer, wherein the extruded compliant layer is non-voided and comprises:

from about 35 to about 80 weight % of a matrix polymer, from about 5 to about 30 weight % of at least one elastomeric polymer that is a thermoplastic polyolefin blend, styrene/alkylene block copolymer, polyether block polyamide, copolyester elastomer, or thermoplastic urethane, or a mixture thereof, and from about 2 to about 25 weight % of an amorphous or semi-crystalline polymer additive.

* * * * *